US006616502B1

(12) United States Patent
Pacza-Steim et al.

(10) Patent No.: US 6,616,502 B1
(45) Date of Patent: Sep. 9, 2003

(54) TOYS WITH SENSORS GENERALLY

(76) Inventors: Elizabeth Pacza-Steim, 5532 W. Agatite, Chicago, IL (US) 60630; David Christianson, 804 Tylerton Cir., Grayslake, IL (US) 60030

( * ) Notice: Subject to any disclaimer, the term of this patent is extended or adjusted under 35 U.S.C. 154(b) by 0 days.

(21) Appl. No.: 10/077,666

(22) Filed: Feb. 19, 2002

(51) Int. Cl.[7] ..... A63H 33/00
(52) U.S. Cl. ..... 446/297; 446/484
(58) Field of Search ..... 446/484, 485, 446/297, 304, 369

(56) References Cited

U.S. PATENT DOCUMENTS 4,820,236 A * 4/1989 Berliner et al. ..... 446/369
6,062,936 A * 5/2000 Rudell et al. ..... 446/71

* cited by examiner

*Primary Examiner*—Jacob K. Ackun
(74) *Attorney, Agent, or Firm*—Marc J. Whipple

(57) ABSTRACT

A toy with electronic sensing mechanism is disclosed. Specifically, the toy can detect the presence of an electrically conductive material and respond accordingly. Particularly disclosed is the use of modeling dough as the conductive material which allows a broad flexibility of play and response.

2 Claims, 1 Drawing Sheet

TOYS WITH SENSORS GENERALLY

BACKGROUND OF THE INVENTION

Toys with Sensors Generally

Although the invention is suitable for a wide variety of applications, the description of the preferred embodiment uses it in a toy application. Toys with sensors are well-known in the toy and game art. These sensing mechanisms are usually concealed switches which are tripped when the appropriate location is impacted on the toy or a specially-shaped implement is used to trigger them, such as a spoon which has a protruding section impacting upon a hidden switch in a doll's mouth.

While this approach works, it would be advantageous to have a less apparent sensing mechanism for greater realism in the doll or other toy in which the sensor is located. Furthermore, it would be desirable to have a sensing mechanism which is less likely to be tripped by accident or with an inappropriate implement or means. The present invention addresses these concerns.

OBJECTS OF THE INVENTION

An object of the invention is to provide a toy with a new and improved electronic sensing mechanism.

A second object of the invention is to provide a toy with a sensing mechanism which can detect the presence of a given material.

A third object of the invention is to provide a toy with a sensing mechanism which is unlikely to be activated by accident or at an inappropriate time.

Other objects and advantages of the invention will become apparent in the following disclosure.

SUMMARY OF THE INVENTION

The present invention relates to an electronic sensing mechanism for toys. Specifically, the toy has a switch comprising contacts which is closed when both contacts are in physical contact with a conducting material. This material may have a given resistance, which can be measured by the electronic sensing mechanism, and if the resistance is too great or too small, the mechanism can reject the signal, reducing false reactions. Of particular interest is the fact that modeling clay or dough has sufficient conductivity to activate such a mechanism, and therefore creative means of reacting to its presence can be incorporated into a toy with the sensing mechanism.

BRIEF DESCRIPTION OF THE DRAWINGS

The characteristic features of the invention will be particularly pointed out in the claims. The descriptions of the preferred embodiment refer to the preceding drawings:

DESCRIPTION OF THE PREFERRED EMBODIMENT

The description of the preferred embodiment uses the invention in a doll which responds to the presence of moldable modeling dough using the invention. The invention is suitable for a wide range of uses, and with the proper linkages could be made to respond to a large variety of media or other materials. "Modeling dough," such as that marketed by Hasbro, Inc., under the trade name "Play-Doh®," is usually made of wood or paper pulp mixed with water as the base ingredients. Any moldable material which has the ability to conduct electricity will serve, although of course if it is intended for use by children it is preferred to use non-toxic materials.

Figure 1:
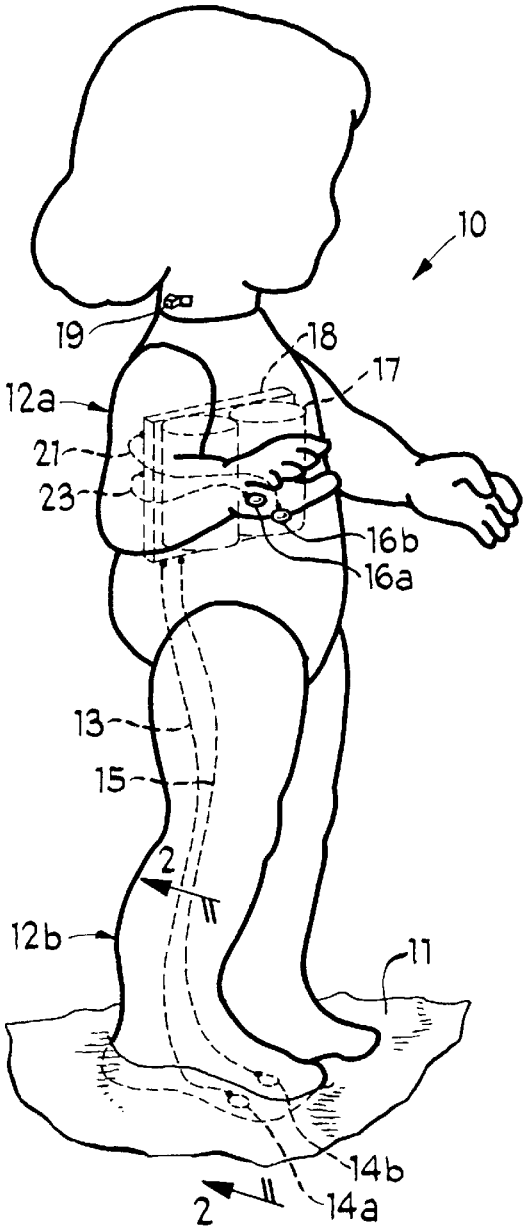
FIG. 1 is a representational profile view of the entire apparatus.

By referring to FIG. 1, the basic concept of the invention may be easily understood. Doll 10 contains controller 18, which is a circuit board with the desired controlling electronics, integrated circuitry, and so forth to enable doll 10 to react as desired to input from the sensing mechanism. Controller 18 may also perform other functions, such as letting the doll talk, respond to her environment in other ways, controlling motivating mechanisms, and so forth. When power switch 19 is actuated, batteries 17 provide power to controller 18, and doll 10 is ready to use. In this embodiment, multiple sensing mechanisms are installed, namely hand sensors 16*a* and 16*b*, and foot sensors 14*a* and 14*b*. These are connected to controller 18 with the indicated wire pairs (21 and 23 for the hand, 13 and 15 for the foot.) The actual working of the mechanism is discussed in the next paragraph with respect to the sensors in leg 12*b*, which would stimulate a response if the doll were "standing" on the appropriate conductor. The sensors in arm 12*b* would function in the same way, but would respond to something doll were "touching" or "holding."

Figure 2:
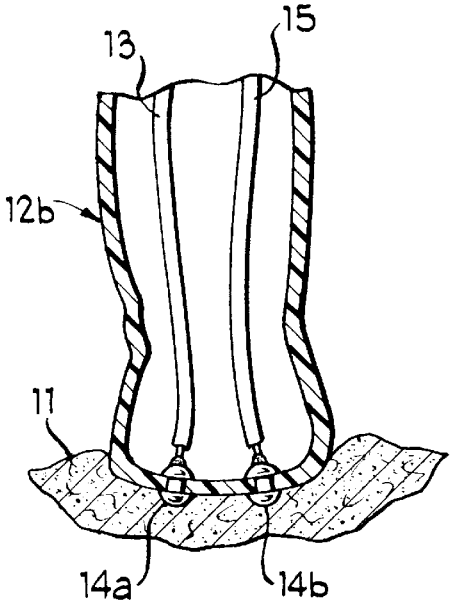
FIG. 2 is a cross-sectional view of the sensing mechanism.

FIG. 2 shows the actual arrangement and activation of the sensors. Doll 10 (see FIG. 1) is in physical contact with modeling dough 11. Modeling dough has the ability to conduct electricity to some degree. When sensor 14*a* and sensor 14*b* are in physical contact with modeling dough 11, an electrical circuit is completed and this can be detected by controller 18 via its connection to the sensors. (See FIG. 1.) Depending on the complexity of controller 18, it can simply detect a closed-circuit condition, which would mean that any conductor which contacted both sensors at the same time would trigger a response, or it may measure the resistivity of whatever is contacting the sensors. A conductor with either too low a resistance or too high a resistance would then not trigger a response. Alternatively, different responses could be triggered by different resistance levels.

If the doll is to respond to a particular material, it is preferred, but not required, that controller 18 have circuitry that is calibrated to respond to the resistivity of that material within the narrowest range which provides the desired response. If modeling dough is to be used to simulate sand at a beach, for instance, and the doll to have a beach "play pattern," controller 18 should be calibrated to respond to the average resistivity of the modeling dough which is anticipated to be used with the doll for this purpose.

While the description above details the preferred and best mode of practicing the invention, many other configurations and variations are possible. For example:

1) The invention need not be practiced as a doll, but could be a simulated piece of construction equipment, an animal, or have some other desired appearance.
2) The sensors need not be in pairs (although two is the minimum number) and may be spaced as desired to provide the desired sensory input of whatever is incorporating the mechanism.

Accordingly, the scope of the invention should be determined not by the embodiment(s) illustrated, but by the claims below and their equivalents.

What is claimed is:

1. A toy with electronic sensing mechanism comprising:

A) A main unit;

B) A controller located in the main unit;

C) A first contact which is electrically connected to the controller and which is mounted in the main unit so as to be able to contact a conducting material, the conducting material comprising modeling dough, in contact with the first contact; and, D) A second contact which is electrically connected to the controller and which is mounted in the main unit so as to be able to contact the conducting material when the conducting material is in physical contact with the first contact such that the conducting material, the first contact, the second contact, and the controller form a complete electrical circuit.

2. A toy with electronic sensing mechanism as in claim 1 wherein the conducting material has a resistivity, and the controller can determine the resistivity of the conducting material when the complete electrical circuit is formed.

* * * * *